US009849363B1

(12) United States Patent
Rahal-Arabi et al.

(10) Patent No.: US 9,849,363 B1
(45) Date of Patent: Dec. 26, 2017

(54) SLALOM RACING GATE MONITOR SYSTEM

(71) Applicant: Intel Corporation, Santa Clara, CA (US)

(72) Inventors: Tawfik M. Rahal-Arabi, Tigard, OR (US); Hong W. Wong, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/192,181

(22) Filed: Jun. 24, 2016

(51) Int. Cl.
*A63B 69/18* (2006.01)
*G08B 5/36* (2006.01)

(52) U.S. Cl.
CPC ..... *A63B 69/187* (2013.01); *G08B 5/36* (2013.01); *A63B 2220/05* (2013.01); *A63B 2220/20* (2013.01); *A63B 2244/19* (2013.01)

(58) Field of Classification Search
CPC ..... A63B 69/187; A63B 2220/05; A63B 2220/20; A63B 2244/19; A63B 24/0062; G08B 5/36; A43B 1/0054; A43B 5/02; G01S 13/34
See application file for complete search history.

(56) References Cited

U.S. PATENT DOCUMENTS

2010/0184563 A1* 7/2010 Molyneux ..... A43B 1/0054 482/1
2010/0184564 A1* 7/2010 Molyneux ..... A43B 1/0054 482/1
2011/0173235 A1* 7/2011 Aman ..... A63B 24/0021 707/792
2011/0304497 A1* 12/2011 Molyneux ..... A43B 1/0054 342/42
2012/0191405 A1* 7/2012 Molyneux ..... A43B 1/0054 702/141
2012/0262329 A1* 10/2012 Molyneux ..... A43B 1/0054 342/42
2013/0130843 A1* 5/2013 Burroughs ..... A63B 71/0686 473/415
2013/0171599 A1* 7/2013 Bleich ..... A61B 5/0456 434/247
2014/0046463 A1* 2/2014 Molyneux ..... A43B 1/0054 700/91
2014/0074263 A1* 3/2014 Balakrishnan ..... A63B 71/0686 700/91

(Continued)

*Primary Examiner* — Orlando Bousono
(74) *Attorney, Agent, or Firm* — Schwegman Lundberg & Woessner, P.A.

(57) ABSTRACT

Systems and methods for providing a slalom racing gate monitor system are provided herein. A system includes a microcontroller; a first, second, and third sensor, each coupled to the microcontroller, the first, second, and third sensors each having a field of view and disposed on a slalom pole, and disposed where the fields of view of the first, second, and third sensors substantially cover a 360 degree field of view around the slalom pole; wherein the microcontroller is to: obtain a sequence of sensor readings from a plurality of sensors of the first, second, and third sensors, each reading in the sequence of sensor readings indicating an object detected in the field of view of the respective sensor; determine whether the object passed the slalom pole on a correct side; and present a notification of whether the object passed the slalom pole on the correct side.

25 Claims, 8 Drawing Sheets

(56) References Cited

U.S. PATENT DOCUMENTS

| | | | | |
|---|---|---|---|---|
| 2014/0288682 | A1* | 9/2014 | Balakrishnan | A63B 71/0686 700/91 |
| 2014/0358261 | A1* | 12/2014 | Molyneux | A43B 1/0054 700/91 |
| 2015/0258373 | A1* | 9/2015 | Molyneux | A43B 1/0054 700/91 |
| 2015/0258413 | A1* | 9/2015 | Molyneux | A43B 1/0054 700/91 |
| 2015/0294141 | A1* | 10/2015 | Molyneux | A43B 1/0054 700/91 |
| 2015/0297951 | A1* | 10/2015 | Molyneux | A43B 1/0054 700/91 |
| 2015/0375044 | A1* | 12/2015 | Molyneux | A43B 1/0054 700/91 |
| 2015/0375085 | A1* | 12/2015 | Molyneux | A43B 1/0054 2/22 |
| 2016/0007849 | A1* | 1/2016 | Krueger | A61B 3/113 600/301 |
| 2016/0059074 | A1* | 3/2016 | Molyneux | A43B 1/0054 700/91 |
| 2016/0059075 | A1* | 3/2016 | Molyneux | A43B 1/0054 700/91 |

* cited by examiner

IF OBJECT'S THERMAL IMAGE DETECTION SEQUENCE IS:
A. SENSOR 1 -> 2 OR 1 -> 2 -> 3
B. SENSOR 2 -> 3 OR 2 -> 3 -> 1
C. SENSOR 3 -> 1 OR 3 -> 1 -> 2
THEN OBJECT PASSED ON THE RIGHT SIDE OF THE POLE

IF OBJECT'S THERMAL IMAGE DETECTION SEQUENCE IS:
A. SENSOR 1 -> 3 OR 1 -> 3 -> 2
B. SENSOR 2 -> 1 OR 2 -> 1 -> 3
C. SENSOR 3 -> 2 OR 3 -> 2 -> 1
THEN OBJECT PASSED ON THE LEFT SIDE OF THE POLE

SLALOM RACING GATE MONITOR SYSTEM

TECHNICAL FIELD

Embodiments described herein generally relate to sensors and in particular, to a slalom racing gate monitor system.

BACKGROUND

Slalom is a form of racing involving skiing or snowboarding between poles or gates. Depending on the variation and type of slalom discipline, the poles or gates are spaced more closely or farther apart. During a race, a contestant is required to maneuver through the gates. It is required that the contestant clear the gates, which means that the contestant properly steers at least their boots around each gate.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

Figure 1:
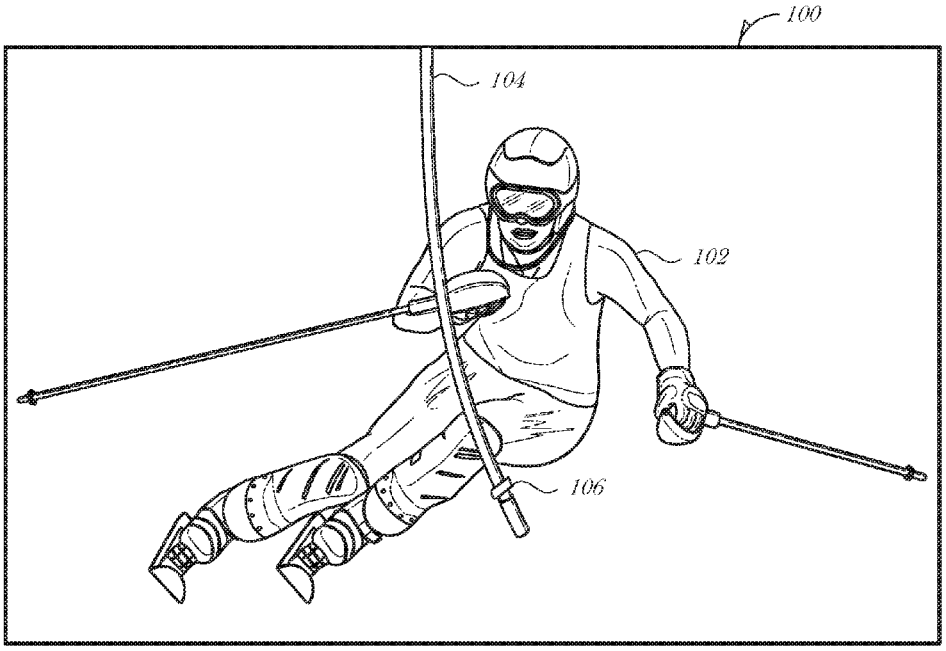
FIG. 1 is a diagram illustrating an environment, according to an embodiment.

In the following description, for purposes of explanation, numerous specific details are set forth in order to provide a thorough understanding of some example embodiments. It will be evident, however, to one skilled in the art that the present disclosure may be practiced without these specific details.

Disclosed herein are systems and methods that provide a slalom racing gate monitor system. In slalom activities, a course is defined using a series of gates. In this document, the terms gate and slalom pole (or just pole) are used interchangeably and refer to the obstacles used in slalom activities. To correctly complete a slalom course, the participant is typically required to alternatively pass on the left and right of each successive gate, weaving their way to the end of the course.

When the poles or gates are spaced closely, such as is the case in a giant slalom course, it is difficult to determine when a competitor properly clears a gate. In the past, rigid posts were used for gates, which forced competitors to maneuver their entire body around each gate. In the early 1980s, rigid poles were replaced with semi-flexible plastic poles hinged at the base. Because the rules only require that a skier or other competitor (e.g., snowboarder) have the skis and boots go around each gate, competitors adjusted their style to what is referred to as the cross-block technique. In the cross-block technique, the skier's skis and feet go around the proper side of the pole, while the skier blocks, or pushes, the pole down with a forearm, shin, or ski pole. In this manner, the skier is able to take a more aggressive approach to the pole (gate) and increase performance. However, with the cross-block technique, it is difficult in some instances to determine whether the skier's skis and boots went around the correct side of a gate pole.

In order to maintain the rules, skiing events typically employ a large number of people to monitor the skiers and make sure that each gate pass is correct. When a skier misses a pass, the gate keeper needs to raise an alert. The process is very prone to human error, which may result in various challenges from competitors and judgments after the race. What is needed is a more efficient and accurate mechanism to act as gate keepers.

Some design considerations that are addressed by this disclosure include the aim that the gate should be easy to set up, reliable, have good power management (as the gates may be deployed for several days during a competition), and be relatively low cost. The sensors described herein accommodate these design considerations and in some configurations, may provide additional functionality such as providing visual indication of whether a competitor committed a gate fault, or provide telemetry to communicate sensor data to a remote site (e.g., for a judge's review). In addition, in some configurations, sensors and "smart gates" are able to communicate with one another and act in concert. In such a configuration, after a skier passes one smart gate, then the lights on the poles of the next gate may illuminate, helping the skier navigate or understand where the next gate is in the course. Other aspects will become apparent in the following discussion.

FIG. 1 is a diagram illustrating an environment 100, according to an embodiment. In the environment 100, a skier 102 is navigating a ski course and maneuvering around a slalom pole. Slalom poles are used in a variety of sports for competition, training, or entertainment. Slalom poles are generally tubular, hollow or solid, with a base that is inserted into the ground. In some slalom poles, a joint is used to join the base to the shaft (e.g., pole). The joint allows the shaft to flex and move when a person impacts the pole. In other slalom poles, a spring, flexible tubing, rubber band, or other attachment mechanism is incorporated into where the base and the shaft are joined to provide flexing. This flexing and movement reduces the chance of injury and also preserves the placement of the slalom pole in the ground. Slalom poles are used in sports and activities, such as alpine ski racing, snowboarding, soccer, rollerblading, American football, and training for such activities.

In FIG. 1, the skier 102 is moving through a gate 104 (e.g., slalom pole). In some cases, the skier 102 is provided a single series of slalom poles through which he must maneuver. In such a configuration, each slalom pole defines a gate.

Figure 2:
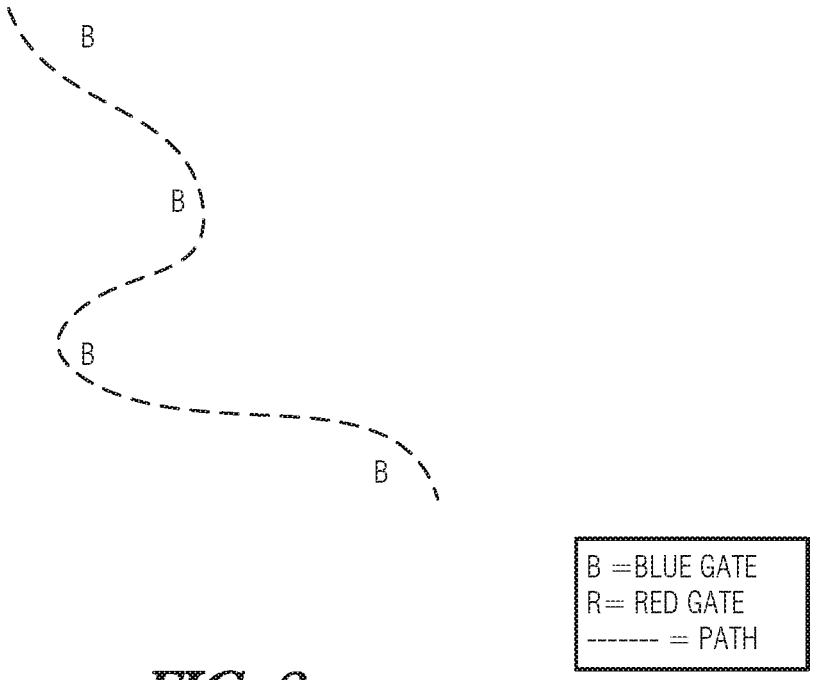
FIGS. 2 and 3 illustrate slalom gate arrangements, according to embodiments.
Figure 3:
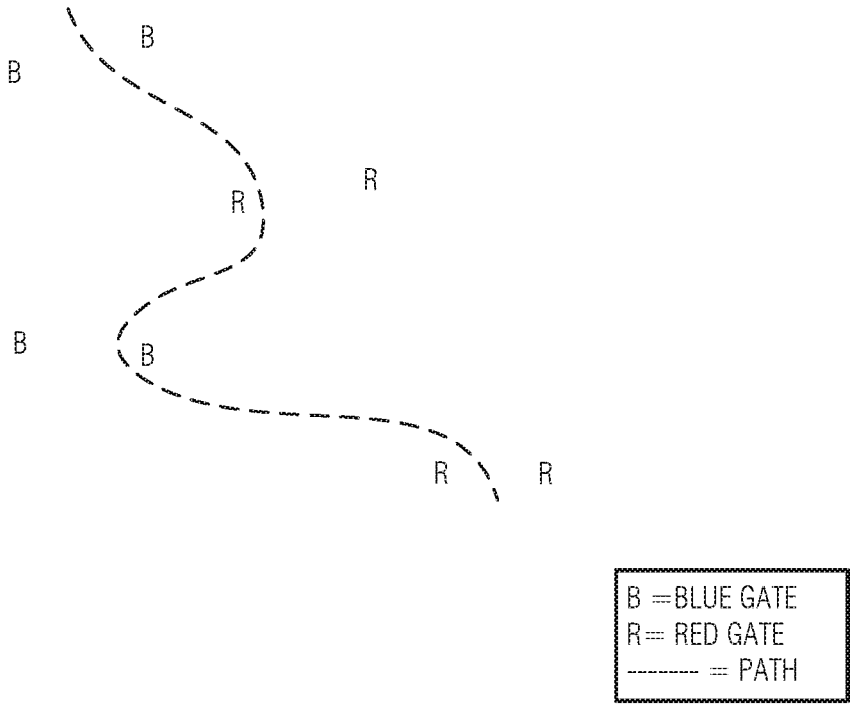

Such a configuration is illustrated in FIG. 2. In other cases, each gate 104 is defined using a pair of slalom poles. In this configuration, poles are color coordinated, usually with red and blue slalom poles. The skier 102 is required to pass through alternating colors of gates to correctly navigate the course. Such a configuration is illustrated in FIG. 3.

Returning to the discussion of FIG. 1, regardless of the course configuration, a sensor array 106 may be installed in the gate 104 (e.g., slalom pole) to monitor the oncoming athlete and determine whether she passes the pole on the left or right side. In the example illustrated in FIG. 1, the sensor array 106 is positioned at a relatively low level to accommodate the cross-blocking skiing style. It is understood that the sensor array 106 may be positioned at any height on the gate 104 to accommodate other types of activities.

Figure 4:
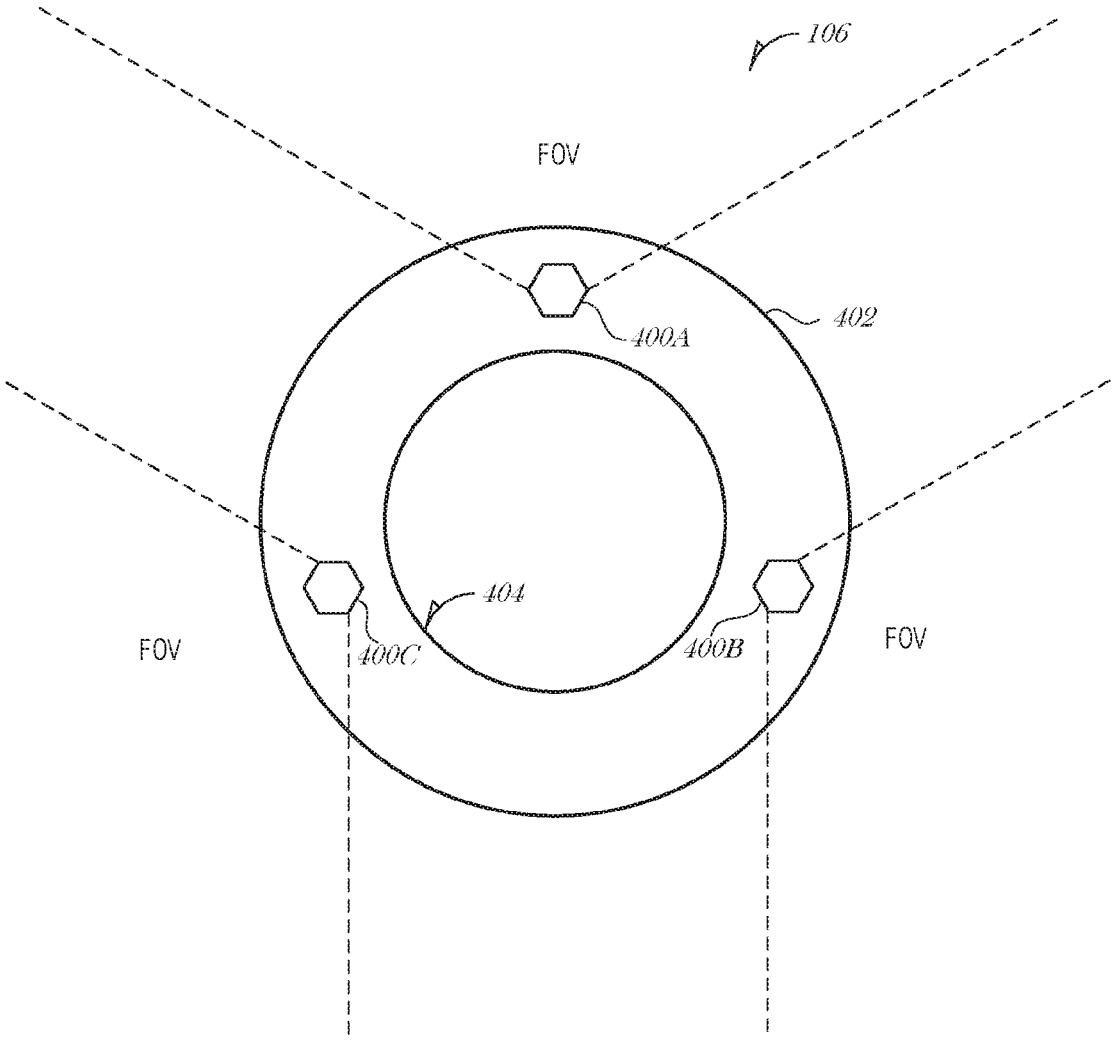
FIG. 4 is a top-down view of a sensor array, according to an embodiment.

FIG. 4 is a top-down view of a sensor array 106, according to an embodiment. The sensor array 106 includes at least three sensors 400A. 400B, 400C. The sensors 400A-C may be any type of sensor capable of detecting an approaching person, such as thermal sensors, cameras, ultrasound motion sensors, Hall effect magnetic sensors, acoustic sensors, or the like. The general approach is the same regardless of which type of sensor is used, however for the purposes of simplifying the discussion, a thermal sensor is referred to herein.

The sensors 400A-C are disposed in a housing 402, which may be affixed temporarily or permanently to a shaft of a slalom pole. Housing 402 may be made of plastic, rubber, metal, or any other suitable material or combination of materials. Housing 402 may be constructed with a material that is compatible with sensor enclosures. For example, if the sensor can is plastic, then the housing 402 may also be made of plastic to avoid signal interference.

Each sensor 400A-C has a field of view (FOV) of approximately 120 degrees, such that the three sensors 400A-C illustrated in FIG. 4 are able to cover the entire 360 degrees around the slalom pole. The FOV of each sensor 400A-C is depicted using dashed lines. It is understood that the FOV is approximate and that although not depicted, some of the FOV of one sensor may overlap that of another sensor. Further, the combined FOV of the sensors 400A-C may not cover the entire 360 degrees, but with proper installation and maintenance, the combined sensor FOV should be enough to provide the functionalities described herein. Additional sensors may be used, in which case the sensors may be configured to cover less than 120 degrees (e.g., four sensors with each having approximately 90 degrees FOV). Sensors 400A-C may have overlapping FOVs in various configurations.

The sensor array 106 may take various forms and be attached to a slalom pole using various mechanisms. For example, the sensor array 106 may have a substantially toroidal shape with a hinge and a latch, such that the shape is openable on the hinge and able to be situated around the circumference of the slalom pole, closed, and then latched. The interior surface 404 of the sensor array 106 may have an adhesive surface, a non-slip surface (e.g., high-density foam, rubber, etc.), or the like, such that when the sensor array 106 is situated around the slalom pole, the sensor array 106 is relatively unmovable and does not slide up or down the slalom pole.

Alternatively, the sensor array 106 may be incorporated into the slalom pole such that the exterior surface of the slalom pole is relatively flush with the exterior surface of the sensor array 106. Such a configuration may be desirable due to an aesthetic preference, a packing or shipping preference, or a manufacturing preference.

Figure 5:
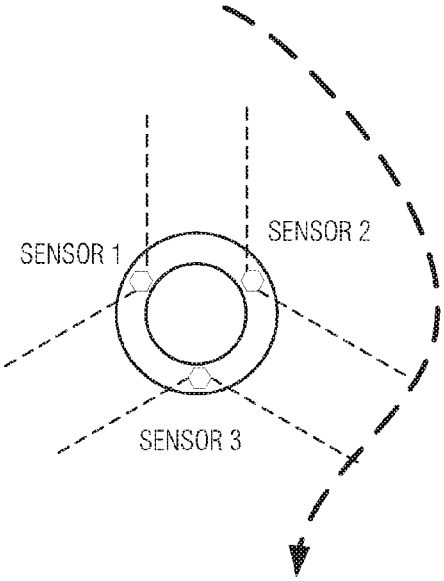
FIGS. 5-8 illustrate various orientations of the sensor array, according to various embodiments.

FIGS. 5-8 illustrate various orientations of the sensor array 106, according to various embodiments. In FIG. 5, the sensor array 106 is oriented in a first position. A person may traverse a path 500 around the slalom pole and the sensor array 106 attached to the slalom pole. Depending on the order that each sensor (Sensor 1, Sensor 2, Sensor 3) senses the person, the person's path is determined-whether person passed on the right or left side of the pole. As such, in FIG. 5, the person is sensed as having passed the Sensor 2 and then the Sensor 3 in that order. Depending on the range of Sensor 1, the person may have been detected and the sensor activation sequence may be Sensor 1-Sensor 2-Sensor 3. In either case, the person is sensed to have passed on the right side. For the purposes of these examples, "right" and "left" are relative to the top-down perspective. It is understood that "right" and "left" may be reoriented based on the perspective used, such as from the person's perspective as she approaches the sensor array 106, in which case the "right" and "left" may be reversed.

Figure 6:
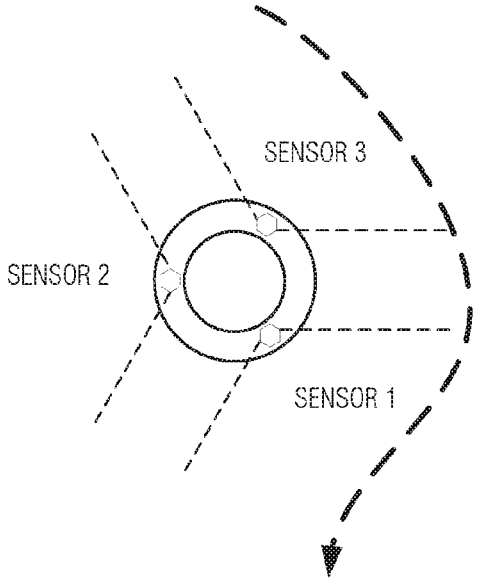
Figure 7:
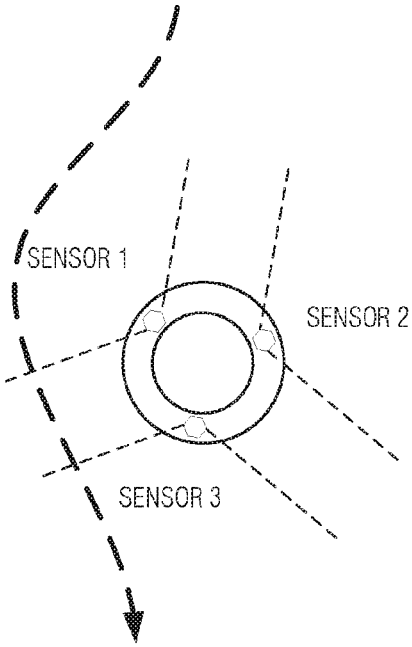
Figure 8:
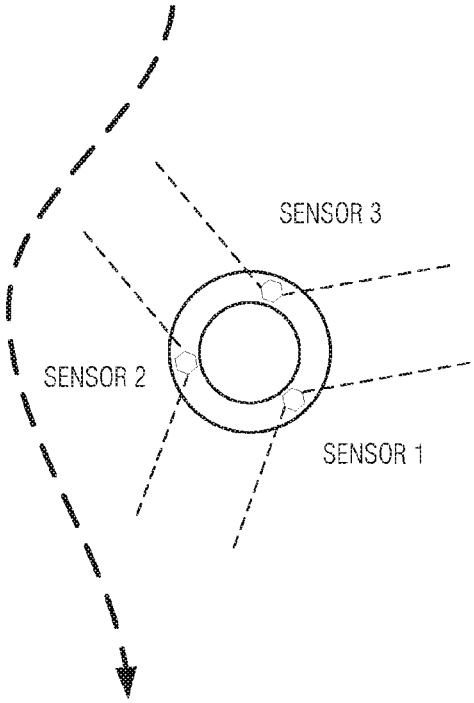

Similarly, FIG. 6 illustrates a sensor detection sequence of Sensor 3-Sensor 1. This indicates that the person passed the right side of the pole. FIG. 7 illustrates a sensor detection sequence of Sensor 1-Sensor 3, indicating a pass on the left. FIG. 8 also illustrates a path to the left with sensor detection sequence of Sensor 3-Sensor 2.

Figures 9, 10:
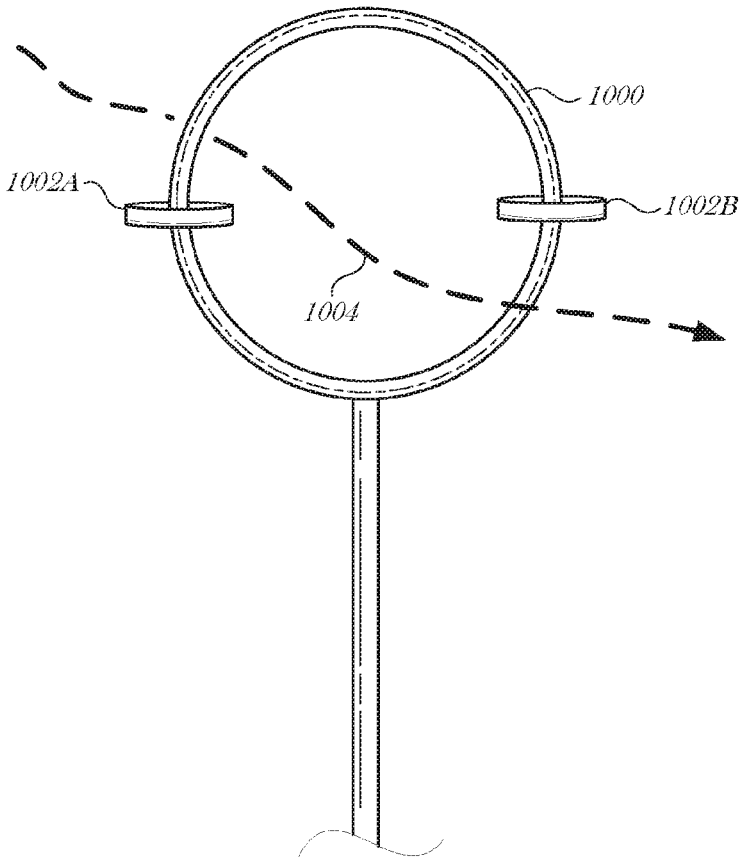
FIG. 9 illustrates various sensor detection sequences, according to an embodiment.
FIG. 10 is a front view of a ring gate arrangement, according to an embodiment.

FIG. 9 illustrates various sensor detection sequences, according to an embodiment. It is understood that these sequences may be extended for four, five, or more sensors. Additionally, multiple sensor arrays may be used on a single slalom pole to provide redundancy.

FIG. 10 is a front view of a ring gate arrangement 1000, according to an embodiment. A ring gate arrangement 1000 may be used in various sports, such as drone races where a drone is flown through the gate arrangement 1000. In such a sport, a successful pass is one where the racing machine or person navigates through the gate (e.g., on path 1004), rather than around it. In the ring gate arrangement 1000, two sensor arrays 1002A, 1002B are illustrated as being attached, incorporated, or affixed to the ring gate arrangement 1000. Each sensor array 1002A-B, may have a configuration as discussed above in FIGS. 4-9, with at least three sensors in each sensor array 1002A-B. In this configuration, the sensor arrays 1002A-B may communicate with one another, or may communicate with a data collector, such as a computer at a judge's station. An object is considered to have successfully passed the gate if it passes on the right of one sensor array 1002A and the left of the corresponding sensor array 1002B. Additional sensor arrays may be positioned on the ring gate arrangement 1000 and incorporated into the determination of whether an object passes through the gate successfully. For example, three, four, or more sensor arrays may be arranged around the frame of the ring gate arrangement 1000 to provide additional sensor readings. Such arrangements may be useful for redundancy.

It is noted that the sensor arrays 1002A-B illustrated in FIG. 10 are drawn to illustrate their orientation and position, but not necessarily their size or shape. For instance, the sensor arrays 1002A-B may be appropriately and suitably sized and shaped to incorporate substantially seamlessly into the profile of the ring gate arrangement, in order to provide a relatively low profile and not interfere with objects passing through or around the frame of the ring gate arrangement.

Figure 11:
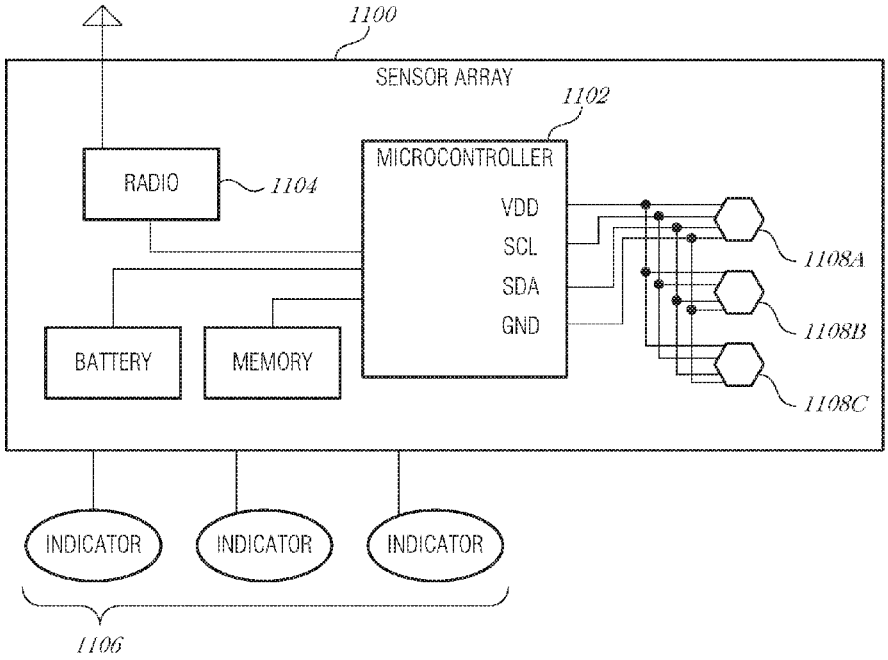
FIG. 11 is a circuit diagram illustrating a sensor array design, according to an embodiment.

FIG. 11 is a circuit diagram illustrating a sensor array design, according to an embodiment. A sensor array 1100 may include a microcontroller 1102 and a radio 1104. In addition, the sensor array 1100 may incorporate or be coupled to one or more indicators 1106. The radio 1104 may be configured to provide a wireless networking communication system. The wireless networking communication system may use one or more of a variety of protocols or technologies, including Wi-Fi, 3G, and 4G LTE/LTE-A, WiMAX networks, Bluetooth, near field communication (NFC), or the like.

The indicators 1106 may include various types of lights (e.g., light-emitting diode (LED), incandescent, etc.). The lights may be colored using a shield, lens, or cover. In the case of LED lights, the lights may be colored based on the type or material used to make up the junction. The indicators 1106 may be used to indicate a successful or unsuccessful pass by the gate. The indicators 1106 may be incorporated into the housing of the sensor array 1100 such that if a clean pass is detected, then one color is illuminated (e.g., green) and if a fault is detected, then another color is illuminated (e.g., red). Alternatively, the indicators 1106 may be housed at a different location, perhaps to improve visibility from a distance. For example, the indicators 1106 may be disposed at the top end of the slalom pole and electrically coupled to the sensor array 1100. The indicators 1106 may illuminate various colors to signal certain conditions (e.g., green for good pass, red for fault or bad pass, yellow for low battery, etc.).

The microcontroller 1102 provides an external supply voltage (Vdd) to each of the sensors 1108A, 1108B, 1108C. In the embodiment illustrated in FIG. 11, the sensors are thermal sensors in the form of infrared thermometers. An example infrared thermometer is part number MLX90614 provided by MELEXIS. A serial clock input (SCL) and digital input/output (SDA) are provided in this embodiment. The serial clock input (SCL) may provide for a 2-wire communication protocol. The SDA provides an object temperature in a pulse width modulated (PWM) signal.

An infrared (IR) thermometer provides of non-contact temperature measurements. An IR sensitive thermopile detector chip may be incorporated into the same can as the signal conditioning circuit, which may amplify an IR signal, convert it to a bit stream, and use a digital signal processor (DSP) for further processing. Various filtering may be performed to acquire an object temperature To and an ambient temperature Ta. The temperature data may be read using the SCL to access memory, or through PWM digital output.

It is understood that other types of thermal sensors may be used in various configurations, and that the configuration illustrated in FIG. 11 is non-limiting.

Figure 12:
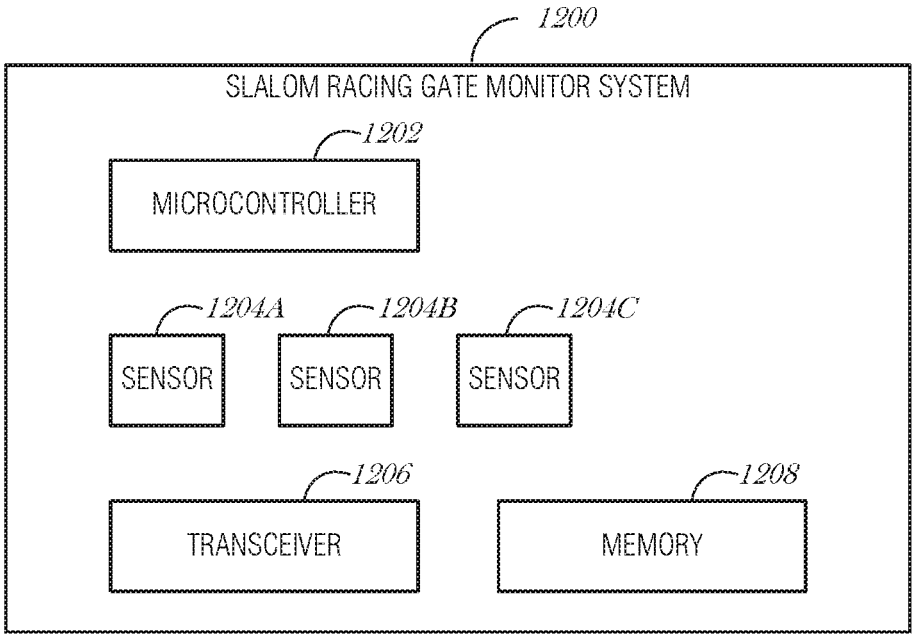
FIG. 12 is a block diagram illustrating a slalom racing gate monitor system, according to an embodiment.

FIG. 12 is a block diagram illustrating a slalom racing gate monitor system 1200, according to an embodiment. The slalom racing gate monitor system 1200 includes a microcontroller 1202, a first sensor 1204A, a second sensor 1204B, a third sensor 1204C, a transceiver 1206, and memory 1208.

The microcontroller 1202, first sensor 1204A, second sensor 1204B, third sensor 1204C, transceiver 1206, and memory 1208 are understood to encompass tangible entities that are physically constructed, specifically configured (e.g., hardwired), or temporarily (e.g., transitorily) configured (e.g., programmed) to operate in a specified manner or to perform part or all of any operations described herein. Such tangible entitles may be constructed using one or more circuits, such as with dedicated hardware (e.g., field programmable gate arrays (FPGAs), logic gates, graphics processing unit (GPU), a digital signal processor (DSP), etc.). As such, the tangible entities described herein may be referred to as circuits, circuitry, processor units, subsystems, or the like.

The first, second, and third sensors 1204A-C are arranged to substantially cover a 360 degree arc in a plane extending radially out from a slalom pole, and the plane being substantially horizontal. The first, second, and third sensors 1204A-C are uniquely identifiable by the microcontroller 1202 such that signal data received from each sensor 1204A-C is distinguishable.

The transceiver 1206 may be configured to transmit over various wireless networks, such as a Wi-Fi network (e.g., according to the IEEE 802.11 family of standards), cellular network, such as a network designed according to the Long-Term Evolution (LTE), LTE-Advanced, 5G or Global System for Mobile Communications (GSM) families of standards, or the like.

In an embodiment, the first, second, and third sensors 1204A-C are each coupled to the microcontroller 1202, the first, second, and third sensors 1204A-C each having a field of view and disposed on a slalom pole, and disposed in a configuration where the fields of view of the first, second, and third sensors 1204A-C substantially cover a 360 degree field of view around the slalom pole.

In an embodiment, the sensors 1204A-C comprise thermal sensors. In another embodiment, the sensors 1204A-C comprise cameras. It is understood that other types of sensors may be used, such as ultrasound.

The microcontroller 1202 may be configured to obtain a sequence of sensor readings from a plurality of sensors of the first, second, and third sensors 1204A-C, each reading in the sequence of sensor readings indicating an object detected in the field of view of the respective sensor. The object may be a person, such as a competitor in a skiing competition. Alternatively, the object may be a metallic armband worn by the participant, such as may be used when the sensors 1204A-C are Hall effect magnetic sensors.

The microcontroller 1202 may then determine whether the object passed the slalom pole on a correct side. Determination of whether the object passed the slalom pole on the correct side may be found using the techniques described above. In particular, the order of the sensors that detected the object may be used to infer the direction and side that the object passed the slalom pole.

Thus, in an embodiment, to determine whether the object passed the slalom pole on the correct side, the microcontroller is to inspect the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass. It is understood that clockwise and counter-clockwise may be reversed to identify a left or right pass as being a successful one. Also, it is understood that clockwise and counter-clockwise are with respect to viewing the slalom pole from the top, looking down the pole to the base where the slalom pole is staked into the ground. Other orientations are understood to be within the scope of this disclosure.

Then, the microcontroller 1202 may present a notification of whether the object passed the slalom pole on the correct side. In an embodiment, to present the notification, the microcontroller 1202 is to activate an indicator. The indicator may be a light, speaker, or other device that provides an audible, tactile, or visible notification. Thus, in an embodiment, the indicator comprises a light. In a further embodiment, to activate the indicator, the microcontroller 1202 is to illuminate a first light when the object passed the slalom pole on the correct side, and illuminate a second light when the object passed the slalom pole on an incorrect side. For example, red and green lights may be used to indicate a fault or a successful pass, respectively.

In an embodiment, the system 1200 includes the transceiver 1206 to transmit the notification to a remote compute device. The remote compute device may be any type of device, such as a laptop, desktop, smartphone, tablet, or the like. The compute device may be in use by a judge, for example, who is monitoring a race. The compute device may alternatively be a recording device, such as an audit device, for judges or participants to access during or after a race, and determine which gates may have been faulted.

In an embodiment, the system 1200 includes a memory 1208 to store the sequence of sensor readings. The memory 1208 may be used for a short-term buffer to store sensor data, or for other uses, such as to store notification information for an entire racing event. The memory 1208 may also store configuration information used by the system 1200 during operation.

In an embodiment, the system 1200) includes a housing, where the microcontroller 1202 and the first, second, and third sensors 1204A-C are disposed in the housing. In a further embodiment, the housing has a substantially toroidal shape. In a related embodiment, an interior portion of the housing has an adhesive contact point to provide bonding to the slalom pole. In another embodiment, an interior portion of the housing has a high-friction surface to resist movement along the slalom pole. The high-friction surface may be rubber, for example, to resist sliding up or down a plastic slalom pole. Other suitable materials are understood to be within the scope of this disclosure.

Figure 13:
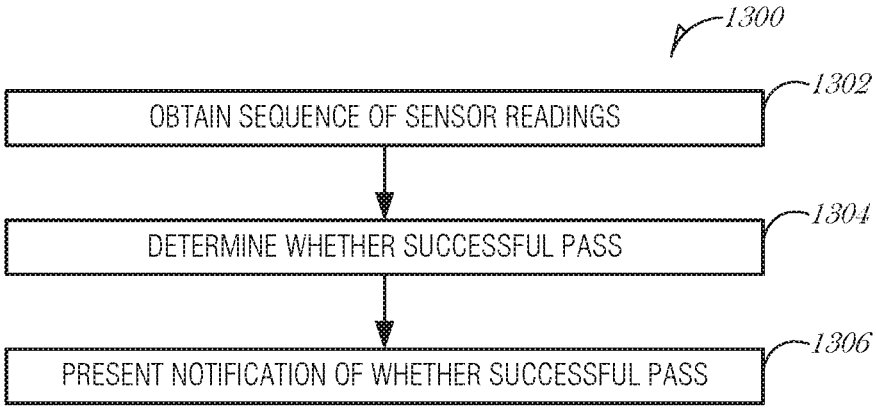
FIG. 13 is a flowchart illustrating a method for providing a slalom racing gate monitor system, according to an embodiment.

FIG. 13 is a flowchart illustrating a method 1300 for providing a slalom racing gate monitor system, according to an embodiment. At block 1302, a sequence of sensor readings from a plurality of sensors of a first, second, and third sensor, are obtained at a microcontroller, each reading in the sequence of sensor readings indicating an object detected in the field of view of the respective sensor, wherein each of the first, second, and third sensor are coupled to the microcontroller, the first, second, and third sensors each having a field of view and disposed on a slalom pole, and disposed in a configuration where the fields of view of the first, second, and third sensors substantially cover a 360 degree field of view around the slalom pole.

In an embodiment, the sensors comprise thermal sensors. In another embodiment, the sensors comprise cameras.

At block 1304, it is determined whether the object passed the slalom pole on a correct side. In an embodiment, determining whether the object passed the slalom pole on the correct side includes inspecting the sequence of sensor readings, the sequence indicating a clockwise traversal of the object with respect to the slalom pole, or a counter-clockwise traversal of the object with respect to the slalom pole, where a clockwise traversal indicates a successful pass and a counter-clockwise traversal indicates an unsuccessful pass.

At block 1306, a notification is presented of whether the object passed the slalom pole on the correct side. In an embodiment, presenting the notification includes activating an indicator. In a further embodiment, the indicator comprises a light. In another embodiment, activating the indicator includes illuminating a first light when the object passed the slalom pole on the correct side, and illuminating a second light when the object passed the slalom pole on an incorrect side.

In an embodiment, the method 1300 includes transmitting the notification to a remote compute device.

In an embodiment, the method 1300 includes, storing the sequence of sensor readings.

In an embodiment, the microcontroller and the first, second, and third sensors are disposed in a housing. In a further embodiment, the housing has a substantially toroidal shape. In another embodiment, an interior portion of the housing has an adhesive contact point to provide bonding to the slalom pole. In a related embodiment, an interior portion of the housing has a high-friction surface to resist movement along the slalom pole.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

A processor subsystem may be used to execute the instruction on the machine-readable medium. The processor subsystem may include one or more processors, each with one or more cores. Additionally, the processor subsystem may be disposed on one or more physical devices. The processor subsystem may include one or more specialized processors, such as a graphics processing unit (GPU), a digital signal processor (DSP), a field programmable gate array (FPGA), or a fixed function processor.

Examples, as described herein, may include, or may operate on, logic or a number of components, modules, or mechanisms. Modules may be hardware, software, or firmware communicatively coupled to one or more processors in order to carry out the operations described herein. Modules may be hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Circuitry or circuits, as used in this document, may comprise, for example, singly or in any combination, hard-wired circuitry, programmable circuitry such as computer processors comprising one or more individual instruction processing cores, state machine circuitry, and/or firmware that stores instructions executed by programmable circuitry. The circuits, circuitry, or modules may, collectively or individually, be embodied as circuitry that forms part of a larger system, for example, an integrated circuit (IC), system on-chip (SoC), desktop computers, laptop computers, tablet computers, servers, smart phones, etc.

Figure 14:
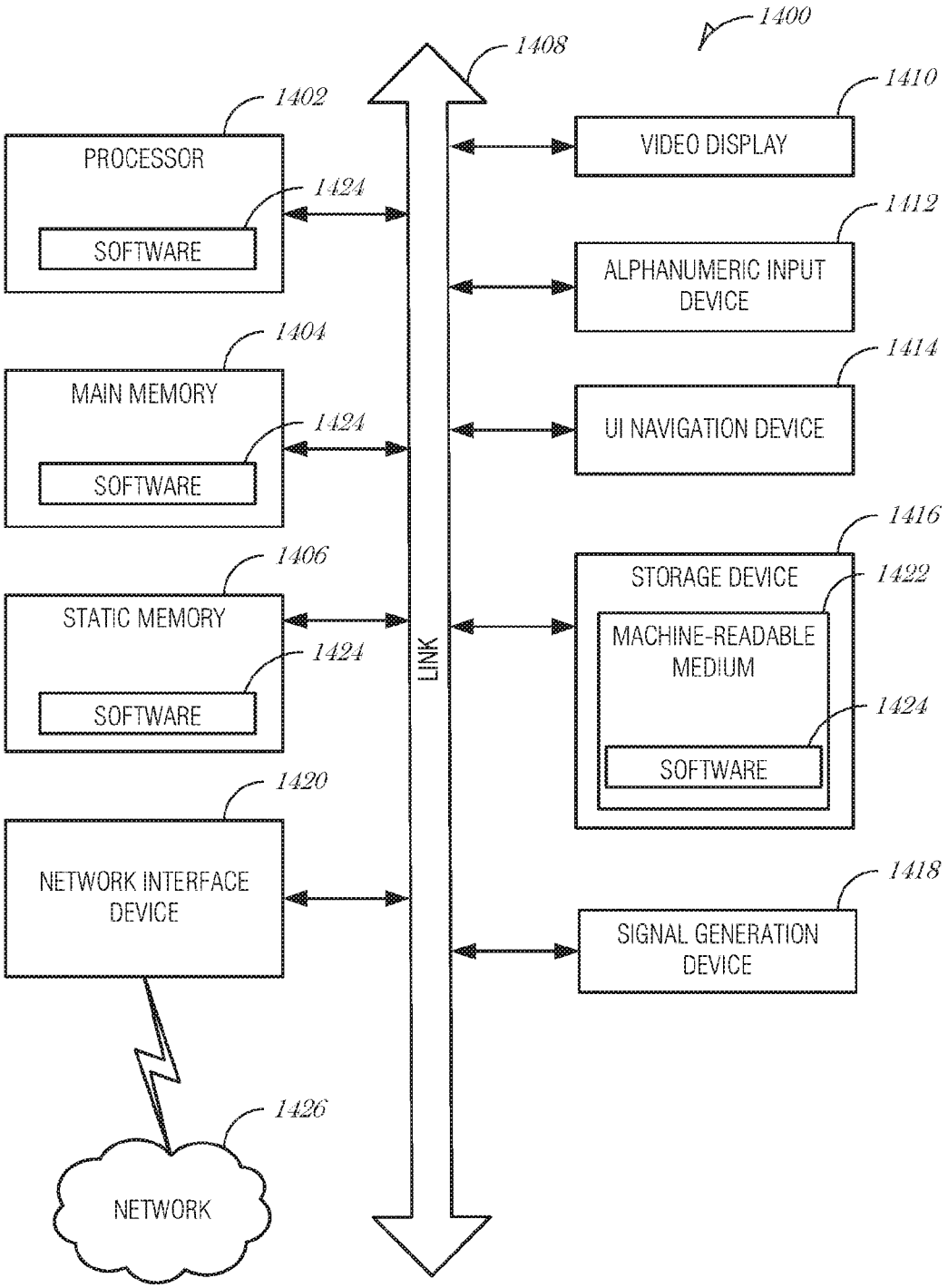
FIG. 14 is a block diagram illustrating an example machine upon which any one or more of the techniques (e.g., methodologies) discussed herein may perform, according to an example embodiment.

FIG. 14 is a block diagram illustrating a machine in the example form of a computer system 1400, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 1400 includes at least one processor 1402 (e.g., a central processing unit (CPU), a graphics processing unit (GPU) or both, processor cores, compute nodes, etc.), a main memory 1404 and a static memory 1406, which communicate with each other via a link 1408 (e.g., bus). The computer system 1400 may further optionally include a video display unit 1410, an alphanumeric input device 1412 (e.g., a keyboard), and a user interface (UI) navigation device 1414 (e.g., a mouse). In an embodiment, the video display unit 1410, input device 1412 and UI navigation device 1414 are incorporated into a touch screen display. The computer system 1400 may additionally optionally include a storage device 1416 (e.g., a drive unit), a signal generation device 1418 (e.g., a speaker), a network interface device 1420, and one or more sensors (not shown), such as a global positioning system (GPS) sensor, compass, accelerometer, gyrometer, magnetometer, infrared, camera, Hall effect magnetic sensor, ultrasound, or other sensor.

The storage device 1416 includes a machine-readable medium 1422 on which is stored one or more sets of data structures and instructions 1424 (e.g., software) embodying or utilized by any one or more of the methodologies or functions described herein. The instructions 1424 may also reside, completely or at least partially, within the main memory 1404, static memory 1406, and/or within the processor 1402 during execution thereof by the computer system 1400, with the main memory 1404, static memory 1406, and the processor 1402 also constituting machine-readable media.

While the machine-readable medium 1422 is illustrated in an example embodiment to be a single medium, the term "machine-readable medium" may include a single medium or multiple media (e.g., a centralized or distributed database, and/or associated caches and servers) that store the one or more instructions 1424. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 1424 may further be transmitted or received over a communications network 1426 using a transmission medium via the network interface device 1420 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Bluetooth, Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

Additional Notes & Examples

Example 1 is a slalom racing gate monitor system, the system comprising: a microcontroller; a first, second, and third sensor, each coupled to the microcontroller, the first, second, and third sensors each having a field of view and disposed on a slalom pole, and disposed in a configuration where the fields of view of the first, second, and third sensors substantially cover a 360 degree field of view around the slalom pole: wherein the microcontroller is to: obtain a sequence of sensor readings from a plurality of sensors of the first, second, and third sensors, each reading in the sequence of sensor readings indicating an object detected in the field of view of the respective sensor; determine whether the object passed the slalom pole on a correct side; and present a notification of whether the object passed the slalom pole on the correct side.

In Example 2, the subject matter of Example 1 optionally includes wherein the sensors comprise thermal sensors.

In Example 3, the subject matter of any one or more of Examples 1-2 optionally include wherein the sensors comprise cameras.

In Example 4, the subject matter of any one or more of Examples 1-3 optionally include wherein to determine whether the object passed the slalom pole on the correct side, the microcontroller is to inspect the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass.

In Example 5, the subject matter of any one or more of Examples 1-4 optionally include wherein to present the notification, the microcontroller is to activate an indicator.

In Example 6, the subject matter of Example 5 optionally includes wherein the indicator comprises a light.

In Example 7, the subject matter of any one or more of Examples 5-6 optionally include wherein to activate the indicator, the microcontroller is to illuminate a first light when the object passed the slalom pole on the correct side, and illuminate a second light when the object passed the slalom pole on an incorrect side.

In Example 8, the subject matter of any one or more of Examples 1-7 optionally include a transceiver to transmit the notification to a remote compute device.

In Example 9, the subject matter of any one or more of Examples 1-8 optionally include a memory to store the sequence of sensor readings.

In Example 10, the subject matter of any one or more of Examples 1-9 optionally include a housing, wherein the microcontroller and the first, second, and third sensors are disposed in the housing.

In Example 11, the subject matter of Example 10 optionally includes wherein the housing has a substantially toroidal shape.

In Example 12, the subject matter of any one or more of Examples 10-11 optionally include wherein an interior portion of the housing has an adhesive contact point to provide bonding to the slalom pole.

In Example 13, the subject matter of any one or more of Examples 10-12 optionally include wherein an interior portion of the housing has a high-friction surface to resist movement along the slalom pole.

Example 14 is a method of providing a slalom racing gate monitor system, the method comprising: obtaining, at a microcontroller, a sequence of sensor readings from a plurality of sensors of a first, second, and third sensor, each reading in the sequence of sensor readings indicating an object detected in the field of view of the respective sensor, wherein each of the first, second, and third sensor are coupled to the microcontroller, the first, second, and third sensors each having a field of view and disposed on a slalom pole, and disposed in a configuration where the fields of view of the first, second, and third sensors substantially cover a 360 degree field of view around the slalom pole; determining whether the object passed the slalom pole on a correct side; and presenting a notification of whether the object passed the slalom pole on the correct side.

In Example 15, the subject matter of Example 14 optionally includes wherein the sensors comprise thermal sensors.

In Example 16, the subject matter of any one or more of Examples 14-15 optionally include wherein the sensors comprise cameras.

In Example 17, the subject matter of any one or more of Examples 14-16 optionally include wherein determining whether the object passed the slalom pole on the correct side includes inspecting the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass.

In Example 18, the subject matter of any one or more of Examples 14-17 optionally include wherein presenting the notification includes activating an indicator.

In Example 19, the subject matter of Example 18 optionally includes wherein the indicator comprises a light.

In Example 20, the subject matter of any one or more of Examples 18-19 optionally include wherein activating the indicator includes illuminating a first light when the object passed the slalom pole on the correct side, and illuminating a second light when the object passed the slalom pole on an incorrect side.

In Example 21, the subject matter of any one or more of Examples 14-20 optionally include transmitting the notification to a remote compute device.

In Example 22, the subject matter of any one or more of Examples 14-21 optionally include storing the sequence of sensor readings.

In Example 23, the subject matter of any one or more of Examples 14-22 optionally include wherein the microcontroller and the first, second, and third sensors are disposed in a housing.

In Example 24, the subject matter of Example 23 optionally includes wherein the housing has a substantially toroidal shape.

In Example 25, the subject matter of any one or more of Examples 23-24 optionally include wherein an interior portion of the housing has an adhesive contact point to provide bonding to the slalom pole.

In Example 26, the subject matter of any one or more of Examples 23-25 optionally include wherein an interior portion of the housing has a high-friction surface to resist movement along the slalom pole.

Example 27 is at least one machine-readable medium including instructions, which when executed by a machine, cause the machine to perform operations of any of the methods of Examples 14-26.

Example 28 is an apparatus comprising means for performing any of the methods of Examples 14-26.

Example 29 is an apparatus for providing a slalom racing gate monitor system, the apparatus comprising: means for obtaining, at a microcontroller, a sequence of sensor readings from a plurality of sensors of a first, second, and third sensor, each reading in the sequence of sensor readings indicating an object detected in the field of view of the respective sensor, wherein each of the first, second, and third sensor are coupled to the microcontroller, the first, second, and third sensors each having a field of view and disposed on a slalom pole, and disposed in a configuration where the fields of view of the first, second, and third sensors substantially cover a 360 degree field of view around the slalom pole; means for determining whether the object passed the slalom pole on a correct side; and means for presenting a notification of whether the object passed the slalom pole on the correct side.

In Example 30, the subject matter of Example 29 optionally includes wherein the sensors comprise thermal sensors.

In Example 31, the subject matter of any one or more of Examples 29-30 optionally include wherein the sensors comprise cameras.

In Example 32, the subject matter of any one or more of Examples 29-31 optionally include wherein the means for determining whether the object passed the slalom pole on the correct side include means for inspecting the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass.

In Example 33, the subject matter of any one or more of Examples 29-32 optionally include wherein the means for presenting the notification include means for activating an indicator.

In Example 34, the subject matter of Example 33 optionally includes wherein the indicator comprises a light.

In Example 35, the subject matter of any one or more of Examples 33-34 optionally include wherein the means for activating the indicator include means for illuminating a first light when the object passed the slalom pole on the correct side, and means for illuminating a second light when the object passed the slalom pole on an incorrect side.

In Example 36, the subject matter of any one or more of Examples 29-35 optionally include means for transmitting the notification to a remote compute device.

In Example 37, the subject matter of any one or more of Examples 29-36 optionally include storing the sequence of sensor readings.

In Example 38, the subject matter of any one or more of Examples 29-37 optionally include wherein the microcontroller and the first, second, and third sensors are disposed in a housing.

In Example 39, the subject matter of Example 38 optionally includes wherein the housing has a substantially toroidal shape.

In Example 40, the subject matter of any one or more of Examples 38-39 optionally include wherein an interior portion of the housing has an adhesive contact point to provide bonding to the slalom pole.

In Example 41, the subject matter of any one or more of Examples 38-40 optionally include wherein an interior portion of the housing has a high-friction surface to resist movement along the slalom pole.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplated are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A slalom racing gate monitor system, the system comprising:

a microcontroller;

a first, second, and third sensor, each coupled to the microcontroller, the first, second, and third sensors each having a field of view and disposed on a slalom pole, and disposed in a configuration where the fields of view of the first, second, and third sensors cover up to and including a 360 degree field of view around the slalom pole;

wherein the microcontroller is to:

obtain a sequence of sensor readings from a plurality of sensors of the first, second, and third sensors, each reading in the sequence of sensor readings indicating an object detected in the field of view of the respective sensor;

determine whether the object passed the slalom pole on a correct side; and present a notification of whether the object passed the slalom pole on the correct side.

2. The system of claim 1, wherein the sensors comprise thermal sensors.

3. The system of claim 1, wherein the sensors comprise cameras.

4. The system of claim 1, wherein to determine whether the object passed the slalom pole on the correct side, the microcontroller is to inspect the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass.

5. The system of claim 1, wherein to present the notification, the microcontroller is to activate an indicator.

6. The system of claim 5, wherein the indicator comprises a light.

7. The system of claim 5, wherein to activate the indicator, the microcontroller is to illuminate a first light when the object passed the slalom pole on the correct side, and illuminate a second light when the object passed the slalom pole on an incorrect side.

8. The system of claim 1, further comprising a transceiver to transmit the notification to a remote compute device.

9. The system of claim 1, further comprising a memory to store the sequence of sensor readings.

10. The system of claim 1, further comprising a housing, wherein the microcontroller and the first, second, and third sensors are disposed in the housing.

11. The system of claim 10, wherein the housing has a toroidal shape.

12. The system of claim 10, wherein an interior portion of the housing has an adhesive contact point to provide bonding to the slalom pole.

13. The system of claim 10, wherein an interior portion of the housing has a high-friction surface to resist movement along the slalom pole.

14. A method of providing a slalom racing gate monitor system, the method comprising:

obtaining, at a microcontroller, a sequence of sensor readings from a plurality of sensors of a first, second, and third sensor, each reading in the sequence of sensor readings indicating an object detected in the field of view of the respective sensor, wherein each of the first, second, and third sensor are coupled to the microcontroller, the first, second, and third sensors each having a field of view and disposed on a slalom pole, and disposed in a configuration where the fields of view of the first, second, and third sensors cover up to and including a 360 degree field of view around the slalom pole;

determining whether the object passed the slalom pole on a correct side; and presenting a notification of whether the object passed the slalom pole on the correct side.

15. The method of claim 14, wherein the sensors comprise thermal sensors.

16. The method of claim 14, wherein the sensors comprise cameras.

17. The method of claim 14, wherein determining whether the object passed the slalom pole on the correct side includes inspecting the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass.

18. The method of claim 14, wherein presenting the notification includes activating an indicator.

19. The method of claim 18, wherein the indicator comprises a light.

20. The method of claim 18, wherein activating the indicator includes illuminating a first light when the object passed the slalom pole on the correct side, and illuminating a second light when the object passed the slalom pole on an incorrect side.

21. At least one non-transitory machine-readable medium including instructions, which when executed by a machine, cause the machine to:

obtain, at a microcontroller, a sequence of sensor readings from a plurality of sensors of a first, second, and third sensor, each reading in the sequence of sensor readings indicating an object detected in the field of view of the respective sensor, wherein each of the first, second, and third sensor are coupled to the microcontroller, the first, second, and third sensors each having a field of view and disposed on a slalom pole, and disposed in a configuration where the fields of view of the first, second, and third sensors cover up to and including a 360 degree field of view around the slalom pole;

determine whether the object passed the slalom pole on a correct side; and present a notification of whether the object passed the slalom pole on the correct side.

22. The at least one non-transitory machine-readable medium of claim 21, wherein the sensors comprise thermal sensors.

23. The at least one non-transitory machine-readable medium of claim 21, wherein the sensors comprise cameras.

24. The at least one non-transitory machine-readable medium of claim 21, wherein the instructions to determine whether the object passed the slalom pole on the correct side include instructions to inspect the sequence of sensor readings, the sequence indicating a clockwise traversal of the object with respect to the slalom pole, or a counter-clockwise traversal of the object with respect to the slalom pole, wherein a clockwise traversal indicates a successful pass and a counter-clockwise traversal indicates an unsuccessful pass.

25. The at least one non-transitory machine-readable medium of claim 21, wherein the instructions to present the notification include instructions to activate an indicator.

* * * * *